US006798333B1

(12) United States Patent
Morikami

(10) Patent No.: US 6,798,333 B1
(45) Date of Patent: Sep. 28, 2004

(54) VARIABLE RESISTOR

(75) Inventor: Masashi Morikami, Fukui-ken (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 136 days.

(21) Appl. No.: 09/708,817

(22) Filed: Nov. 8, 2000

(30) Foreign Application Priority Data

Nov. 8, 1999 (JP) ..... 11-316788

(51) Int. Cl.[7] ..... H01C 10/32
(52) U.S. Cl. ..... 338/162; 338/202; 338/163
(58) Field of Search ..... 338/162, 190, 338/163, 169, 170, 202, 168

(56) References Cited

U.S. PATENT DOCUMENTS 3,683,308 A * 8/1972 Hamill ..... 338/162
4,717,903 A * 1/1988 Hinterberger ..... 338/162
5,047,746 A * 9/1991 Stilwell et al. ..... 338/162
5,053,742 A * 10/1991 Masuda ..... 338/162
5,699,037 A * 12/1997 Masuda ..... 338/162
5,790,012 A * 8/1998 Nakatsu et al. ..... 338/152
5,982,272 A * 11/1999 Masuda ..... 338/162
6,111,493 A * 8/2000 Onishi et al. ..... 338/162
6,380,841 B2 * 4/2002 Masuda et al. ..... 338/163

FOREIGN PATENT DOCUMENTS

JP 55-152009 4/1979
JP 58-127800 8/1983
JP 1-308001 12/1989

* cited by examiner

*Primary Examiner*—Karl D. Easthom
(74) *Attorney, Agent, or Firm*—Keating & Bennett, LLP

(57) ABSTRACT

A variable resistor is constructed to prevent a slider from backwardly tilting toward a rotor and to maintain stable contact between the slider and a substrate. In the variable resistor, a rotor and a slider are provided in a case. A substrate having a collector electrode and an arcurate resistor is mounted in the lower end portion of the case. The slider includes an annular arm portion arranged to achieve sliding contact with the arcurate resistor, a substantially I-shaped arm portion arranged to contact the collector electrode, and a case portion coupled with the annular arm portion and the substantially I-shaped arm portion by a folded-back structure. The base portion extends up to the vicinity of the position corresponding to the tip portion of the annular arm portion. The rear surface of the base portion is supported by the rotor such that the slider is prevented from backwardly tilting.

26 Claims, 9 Drawing Sheets

VARIABLE RESISTOR

BACKGROUND OF THE INVENTION

1. Field of the Invention

The present invention relates to a variable resistor used in devices such as a hearing aid, a measuring instrument, communications equipment, a sensor, or other such electronic apparatus, and in particular, the present invention relates to a miniaturized variable resistor.

2. Description of the Related Art

In recent years, reduction in the size and the weight of electronic equipment has been desired, and the reduction in the size and the weight of the circuit components provided within such electronic equipment has also been desired. An ultra-miniature variable resistor having a diameter or side length of about 2 mm has been used as a circuit component. A variable resistor requires a slider which is a spring component. However, the miniaturization of the slider makes it difficult to achieve good electrical contact and sliding characteristics.

FIGS. 1 and 2 show a conventional ultra-miniature variable resistor having a structure in which a shaft 2, a rotor 3, a slider 4, and a substrate 5 are provided in a case 1 and which are sealed by filling a sealing resin 6 such as epoxy resin in the bottom opening of the case 1. Lead terminals 71, 72, and 73 are fixed on the substrate 5. The lead terminals are electrically connected to both sides of an arcuate resistor 51 and a collector electrode 52, respectively.

As shown in FIG. 3, the slider 4 is defined by a thin metallic plate having a annular arm portion 41 making sliding contact with the arcuate resistor 51 of the substrate 5 and an I-shaped arm portion 42 arranged to contact the collector electrode 52 of the substrate 5. The annular arm portion 41 is bent up at the portion corresponding to the diameter, and the I-shaped arm portion 42 extends in a direction that is substantially perpendicular to the bent-up line of the annular arm portion 41 and is located inside of the annular arm portion 41. In the left side view of FIG. 3, the solid line designates the slider under a load, and the two-dot chain line designates the slider without a load. In the slider 4, a pair of through holes 44 for fitting the protrusions 31 (see FIG. 4) of the rotor 3 are provided at bilaterally symmetrical positions around the I-shaped arm portion 42. The slider 4 is mounted on the rotor 3 so as to he rotatable together with the rotor 3, by fitting the protrusions into the through holes 44 and then crushing the protrusions 31 by weld-caulking.

As shown in FIGS. 5A and 5B when the substrate is mounted in the variable resistor, both of the annular arm portion 41 and the I-shaped arm portion 42 are subjected to a load. As a result, a moment M in the backward-tilting direction of the slider 4 occurs about the bending-up line 43 (see FIG. 5B). The distance between the the protrusions 31 and the bending-up line 43 define the fulcrum about which the moment M acts. Once a backward-tilting of the slider 4 occurs, a problem arises that the contact between the resistor 51 and the annular arm portion 41 and the contact between the collector electrode 52 and the I-shaped arm portion 42 become unstable, resulting in a reduction in the reliability of the variable resistor.

In order to prevent the slider 4 from backwardly tilting, the protrusions 31 of the rotor 3 are weld-caulked. However, because the two protrusions 31 are arranged in the vicinity of the bending-up line 43, the distance between the protrusions 31 and the bending-up line 43 defining the fulcrum is small. Because the distance defining the fulcrum is small, the backward-tilting of the slider 4 cannot be effectively prevented. Furthermore, in the case of very small components, protrusions 31 having a sufficient size cannot be formed on the rotor 3, and the weld-caulking of the protusions 31 is very difficult. For example, when the diameter of the slider 4 is 1.5 mm, the diameter of the protrusions needs to be about 0.2 mm to effectively prevent the backward-tilting of the slider 4. The process of welding such small protrusions 31 is thus very difficult, and a desired fixing strength cannot be reliably achieved even though welding is executed.

SUMMARY OF THE INVENTION

In order to overcome the problems described above, the preferred embodiments of the present invention provide a variable resistor arranged to effectively and reliably prevent a slider from backwardly tilting toward a rotor, thereby maintaining a stable contact between the slider and a substrate.

According to one of the preferred embodiments of the present invention, a variable resistor includes a case, a rotor rotatably accommodated in the case, the rotor being rotationally operated from the outside of the case, a substrate located in the case, the substrate having a collector electrode at an approximate central portion of the surface thereof, and having an arcuate resistor disposed around the collector electrode so as to be substantially concentric therewith, a slider mounted on the rotor so as to be rotatable together with the rotor. The slider having an annular arm portion arranged to achieve sliding contact with the arcuate resistor on the substrate, a substantially I-shaped arm portion arranged to contact the collector electrode, and a base portion that is integral with the slider. The base portion being coupled at one end thereof with the annular arm portion and the substantially I-shaped arm portion by a folded back structure. The base portion extends up to the vicinity of the position corresponding to the tip portion of the annular arm portion. The rear surface of the base portion is supported by the rotor. In this variable resistor, the annular arm portion is bent up at the portion corresponding to the diameter or at the portion in the vicinity of the diameter. The substantially I-shaped arm portion extends in a direction that is substantially perpendicular to the bent-up line of the annular arm portion and is located inside the annular arm portion.

The annular arm portion of the slider rotates and makes sliding contact with the arcuate resistor of the substrate. The substantially I-shaped arm portion makes contact with the collector electrode of the substrate. When both the annular arm portion and the substantially I-shaped arm portion are under a load, a moment about the bent-up line of the annular arm portion and in the backward-tilting direction acts on the slider. In the slider in accordance with a preferred embodiment of the present invention, a base portion is integral with the slider. The base portion is coupled with the annular arm portion and the substantially I-shaped arm portion by a folded back structure. The base portion extends up to the vicinity of the position corresponding to the tip portion of the annular arm portion. With this configuration, the base portion supports the moment in the backward-tilting direction and prevents the slider from backwardly tilting. This stabilizes the contact between the resistor and the annular arm portion and the contact between the collector electrode and the substantially I-shaped arm portion, which leads to an improvement in the reliability of the variable resistor.

Preferably, the annular arm portion, the substantially I-shaped arm portion, and the base portion are coupled such that the base portion is folded back, and the annular arm portion, the substantially I-shaped arm portion, and the base portion are closely contacted by the folded-back structure. Thereby, the height dimension of the slider can be made smaller than the structures of the prior art. This allows variable resistors of the preferred embodiments of the present invention to have lower profiles.

It is preferable that the substantially I-shaped arm portion is raised without folding the substantially I-shaped arm portion. This is accomplished by bending a portion of the folded-back portion in the direction opposite to the bending-up direction of the annular arm portion. In the slider having a conventional structure, because the substantially I-shaped arm portion is bent and raised, work-hardening occurs in the bent portion under the influence of bending work. The work-hardening of the bent portion results in the elastic region in the substantially I-shaped arm portion becoming samller. That is, the effective spring length $L_1$ of the substantially I-shaped arm portion (see FIG. 5A) becomes smaller. This causes the problem that the contact pressure between the substantially I-shaped arm portion and the collector electrode becomes greater than is needed. On the other hand, in the above-described construction in accordance with a preferred embodiment of the present invention, the work-hardening due to bending work is prevented because the substantially I-shaped arm portion is substantially linear, and the raising of the root portion of the substantially I-shaped arm portion by folding is not done. and the stress with respect to the load disperses throughout the substantially I-shaped arm portion. This results in the substantially I-shaped arm portion having a wider elastic region. That is, it is possible to make the effective spring length longer and to set the contact pressure between the substantially I-shaped arm portion and the collector electrode to an appropriate value.

Preferably, a pair of through holes for fitting the protrusions of the rotor are provided in the annular arm portion and the base portion in the vicinity of the folded back portion and substantially at bilaterally symmetrical positions around the substantially I-shaped arm portion. Specifically, the through holes are preferably arranged at common positions relative to the annular arm portion and the base portion. The insertion of the protrusions of the rotor into the through holes of the slider prevents the slider from slipping with respect to the rotor, when the rotor is rotated. Because the slider is prevented from backwardly tilting, there is no need to fix the protrusions by weld-caulking. Also, thin protrusions do not cause any problem because the load applied on the protrusions is small.

The above-described variable resistor in accordance with a preferred embodiment of the present invention may be applied to hearing aids. In hearing aids, variable resistors are used for sensibility adjustment or other adjustment. In accordance with the desire to miniaturize hearing aids, miniature size variable resistors have been required. Use of a variable resistor having stable characteristics allows the reliability of a hearing aid to be greatly improved.

In the present invention, the method for attaching the slider and rotor is not limited to the conventional method in which the protrusions are weld-caulked. This is because the slider would not slip with respect to the rotor because of the spring forces of the arm portions.

The above and other characteristics, elements, features, and advantages of the present invention will be apparent from the following detailed description of preferred embodiments of the invention in conjunction with the accompanying drawings.

DETAILED DESCRIPTION OF PREFERRED EMBODIMENTS

Figure 1:
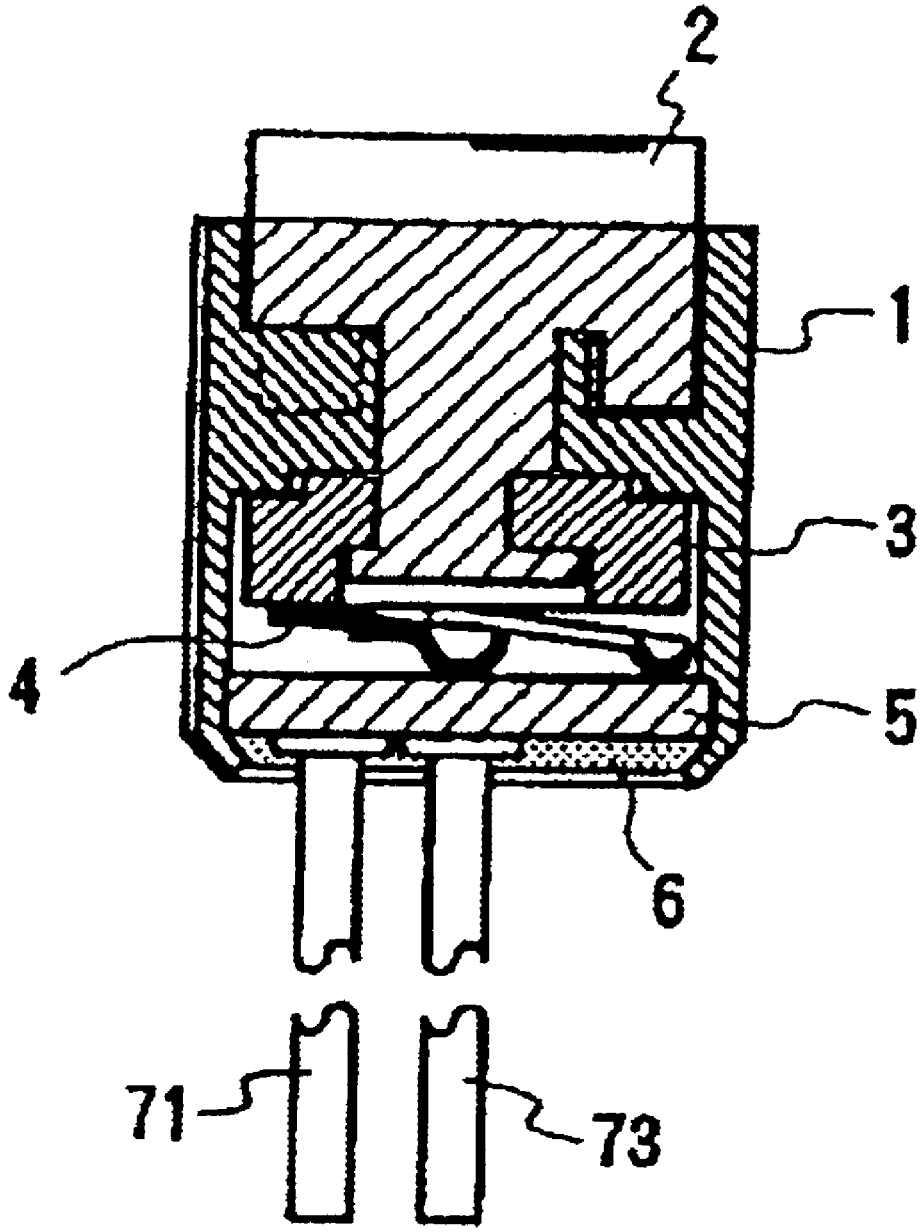
FIG. 1 PRIOR ART
FIG. 1 is a cross-sectional view showing a conventional variable resistor.
Figure 2:
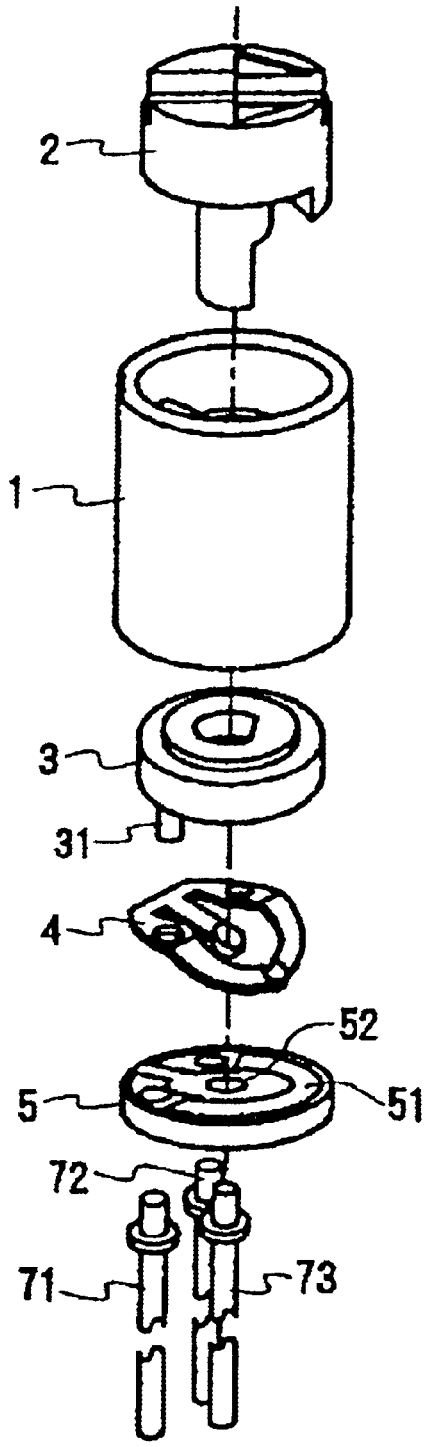
FIG. 2 PRIOR ART
FIG. 2 is an exploded perspective view showing the variable resistor shown in FIG. 1.
Figure 3:
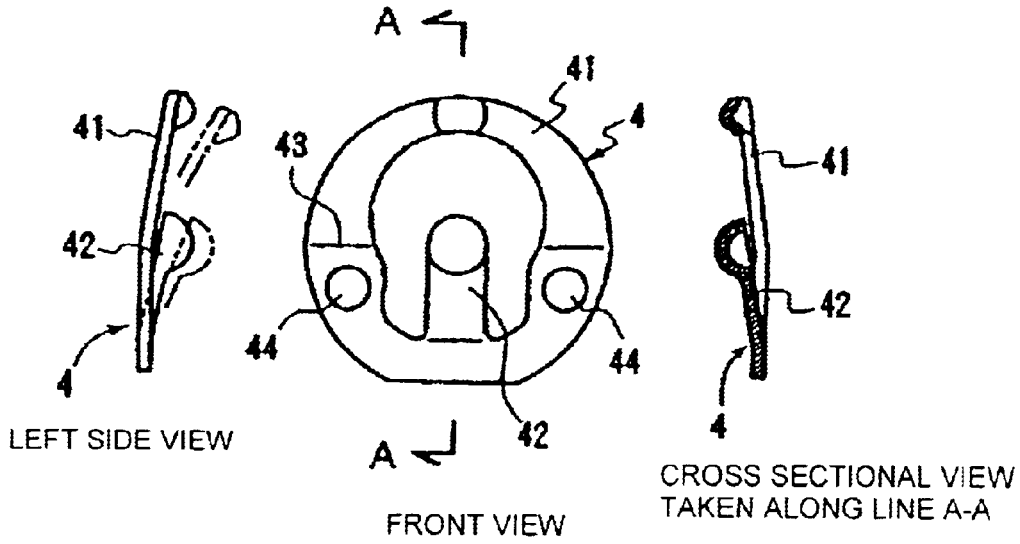
FIG. 3 PRIOR ART
FIG. 3 illustrates a left-side view, a front view, and a cross-sectional view taken along the line A—A in the front view, each showing the slider included in the variable resistor in FIG. 1.
Figure 4:
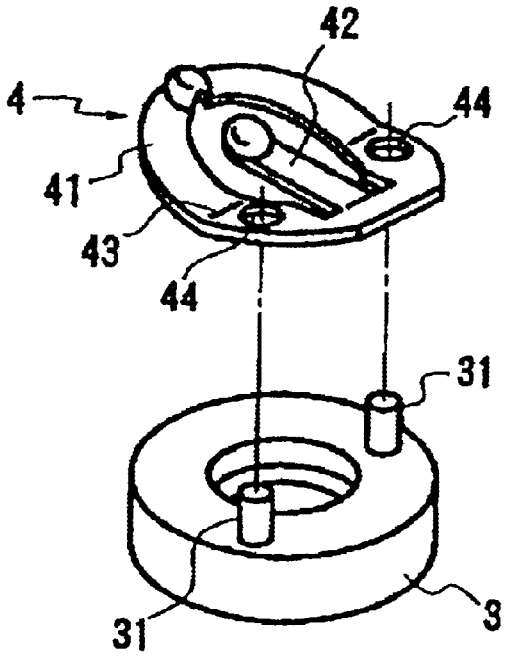
FIG. 4 PRIOR ART
FIG. 4 is a perspective view showing the slider and rotor used in the variable resistor shown in FIG. 1, as viewed from the rear side.
Figure 5A:
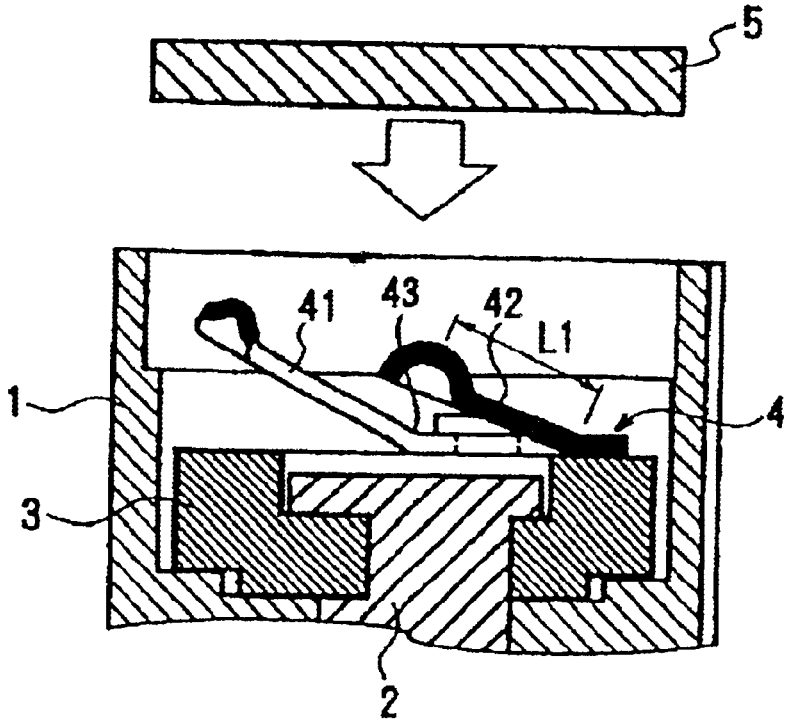
FIG. 5A PRIOR ART
FIGS. 5A and 5B are partially sectional views illustrating the variable resistor before and after the substrate is built in the variable resistor shown in FIG. 1, respectively.
Figure 5B:
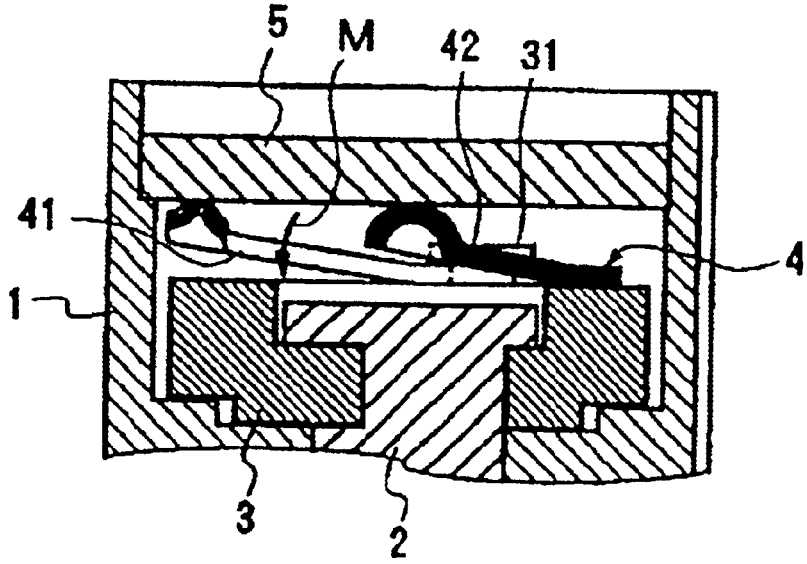
FIG. 5B PRIOR ART

FIGS. 6 through 11 illustrate an example of a variable resistor in accordance with a preferred embodiment of the present invention. This example of a variable resistor is used for, for example, a hearing aid.

Because this variable resistor has the same structure as the variable resistor shown in FIGS. 1 through 5, except for the slider 8, the same elements and parts as shown in FIGS. 1 through 5 are identified by the same reference numerals in FIGS. 6 through 11 to avoid repetitive description.

A case 1 is molded in one piece so as to have a substantially cylindrical shape using a heat-resistant thermoplastic resin or thermosetting resin, in order to resist the heating generated by soldering and to allow a stable operation in a high-temperature atmosphere.

A substantially circular opening 11 is provided in the top surface of the case 1, and a stopper portion 12 is arranged to protrude from the inner peripheral surface thereof. A stopper portion 21 for a shaft 2 is inserted into the opening 11, and the rotational angle of the shaft 2 is regulated by abutting the stopper portion 21 of the shaft against the stopper portion 12 of the case. The shaft 2 is also preferably made of the same material as the case 1, but may alternatively be formed of a metal. On the top end surface of the shaft 2, a tool engaging groove 22 is arranged to extend in adiametric direction. A thin shaft portion 23 is arranged to protrude from the bottom end surface of the shaft 2. A substantially cylindrical internal space 13 accommodating the rotor 3, the slider 8, and the substrate 5 is provided in the lower portion of the case 1. The substrate 5 is fitted to the lower-end opening portion 14 of the case 1. The substrate 5 is prevented from slipping off the lower-end opening portion 14 by inwardly thermal-caulking the end portion of this opening portion. A sealing resin is filled into the recess defined by the lower-end opening portion 14 and the substrate 5 and is arranged to seal the recess.

The rotor 3 is also molded in one piece into a disk shape using the same material as the case 1, and a hole 32 to be fitted into the shaft portion 23 of the shaft 2 is provided at the approximate center of the rotor. The shaft 2 and the rotor 3 are integrated, by inserting the shaft portion 23 of the shaft 2 into the hole 32, and thermal-caulking the tip thereof. Instead of using of the method in which the tip of the shaft portion 23 is thermal-caulked, , a claw portion, for preventing the shaft portion 23 from slipping off, may be provided at the tip of the shaft portion 23 as a coupling member of the shaft 2 and rotor 3. Two protrusions 31 are provided on the bottom surface of the rotor 3 for preventing the slipping rotation of the slider 8 with respect to the rotor 3.

Figure 6:
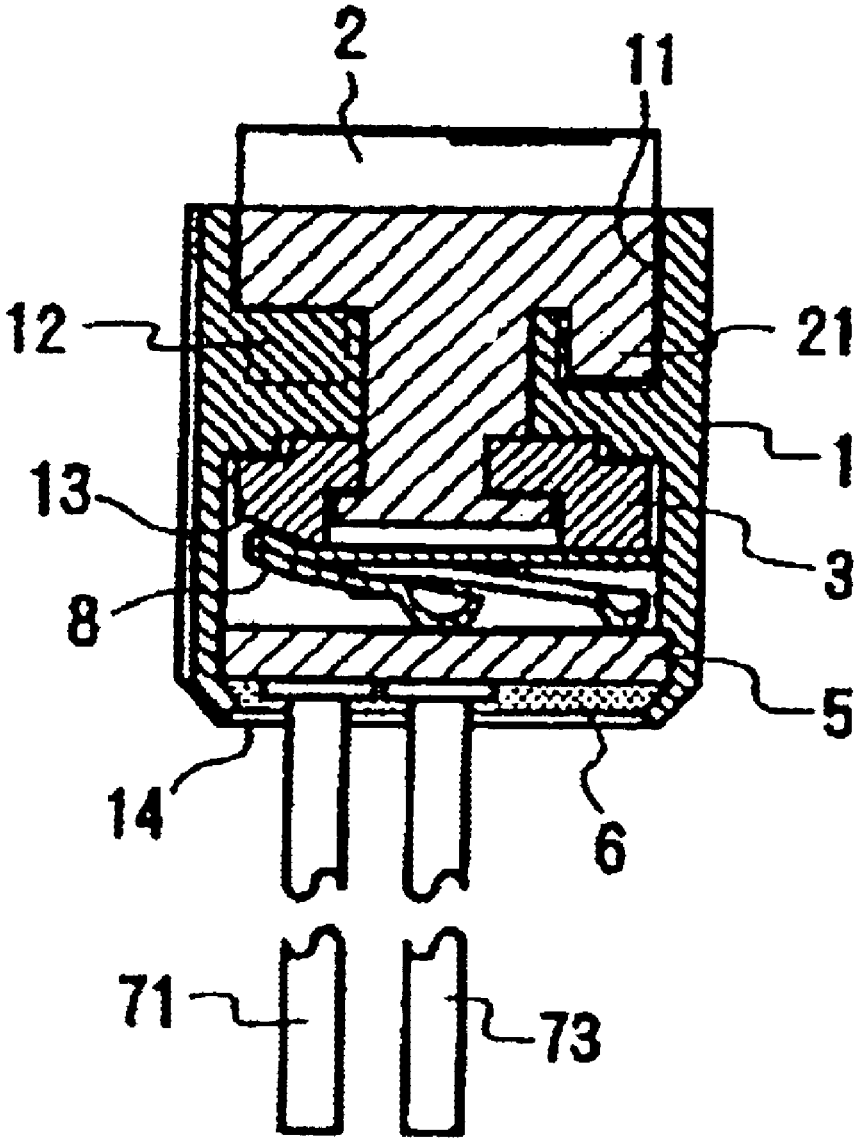
FIG. 6 is a cross-sectional view illustrating an example of a variable resistor in accordance with a preferred embodiment of the present invention.
Figure 7:
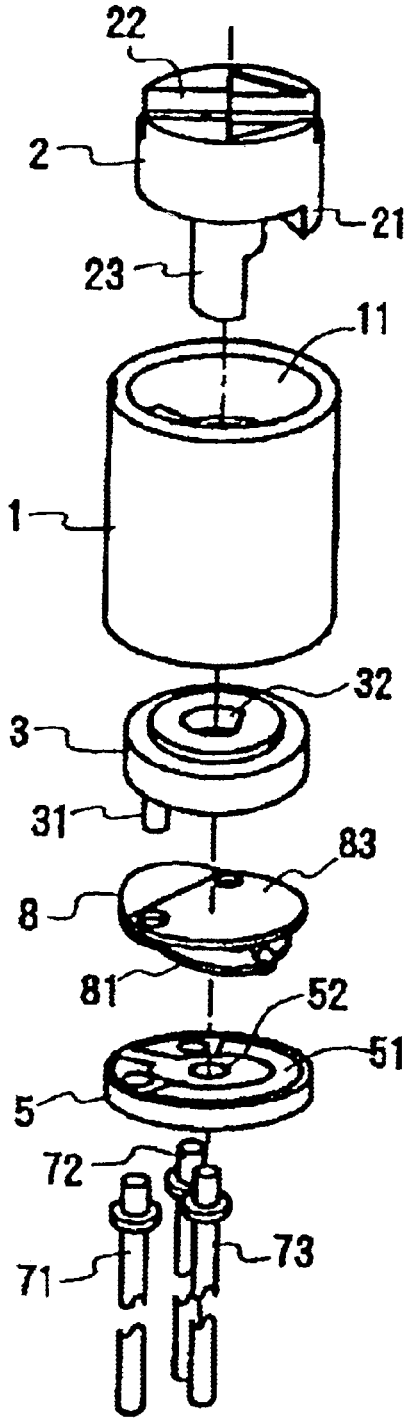
FIG. 7 is an exploded perspective view illustrating the variable resistor shown in FIG. 6.

The substrate 5 defines a disk to be fitted into the lower-end opening 14 of the case 1 and is molded using the same material as the case 1. A through hole is provided at the approximate center of the surface of the substrate 5. The upper end of the lead terminal 73 is fitted into the approximately central through hole and is exposed on the surface of the substrate 5. The upper end of the lead terminal 73 constitutes a collector electrode 52. An arcuate resistor 51 is provided on the surface of the substrate 5 around the collector electrode 52. Through holes are also provided in both ends of the resistor 51. The lead terminals 71 and 72 are inserted into these through holes and are connected to both ends of the resistor 51. FIGS. 6 and 7 show an example of a lead terminal type variable resistor in which the lead terminals 71–73 are inserted into the through holes in the substrate 5, but the type of variable resistor is not limited to this type. The variable resistor in accordance with various preferred embodiments of the present invention may be constructed as a surface-mount type, omitting the lead terminals 71–73.

Figure 8:
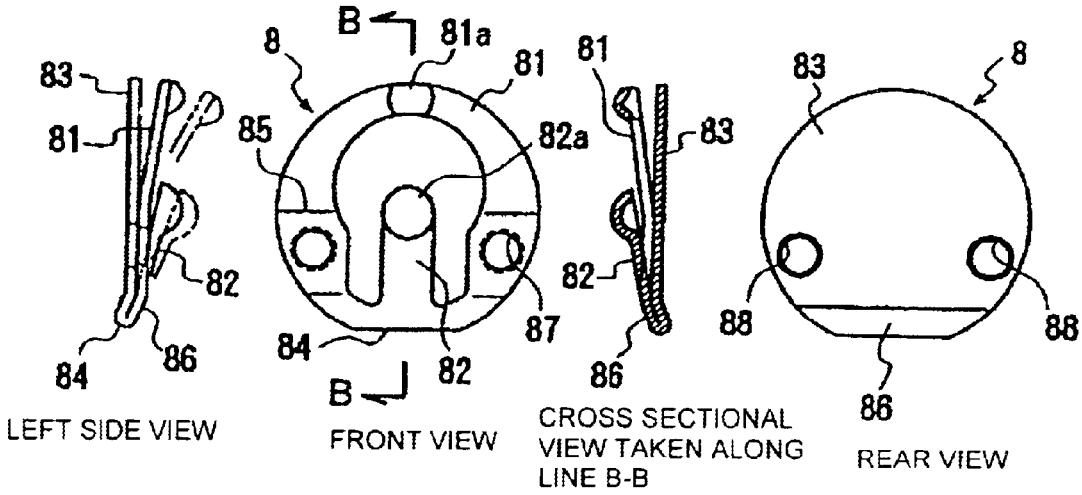
FIG. 8 illustrates a left side view, a front view, a cross-sectional view taken along the line B B in the front view, and a rear elevation each showing the slider used in the variable resistor in FIG. 6.
Figure 9:
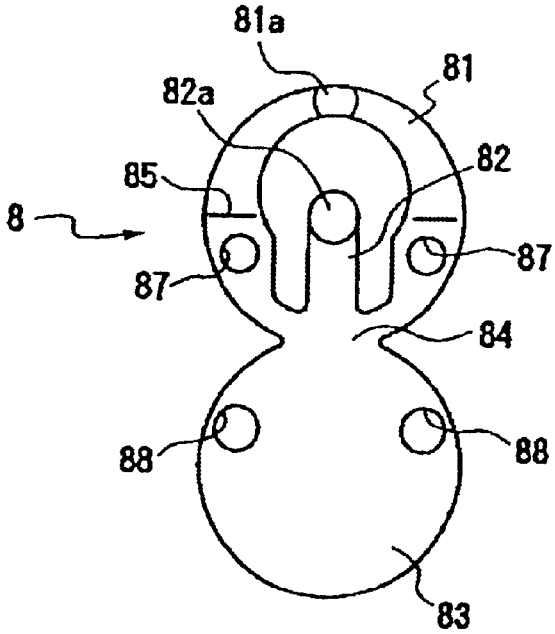
FIG. 9 is a front development view illustrating the slider shown in FIG. 8.
Figure 10:
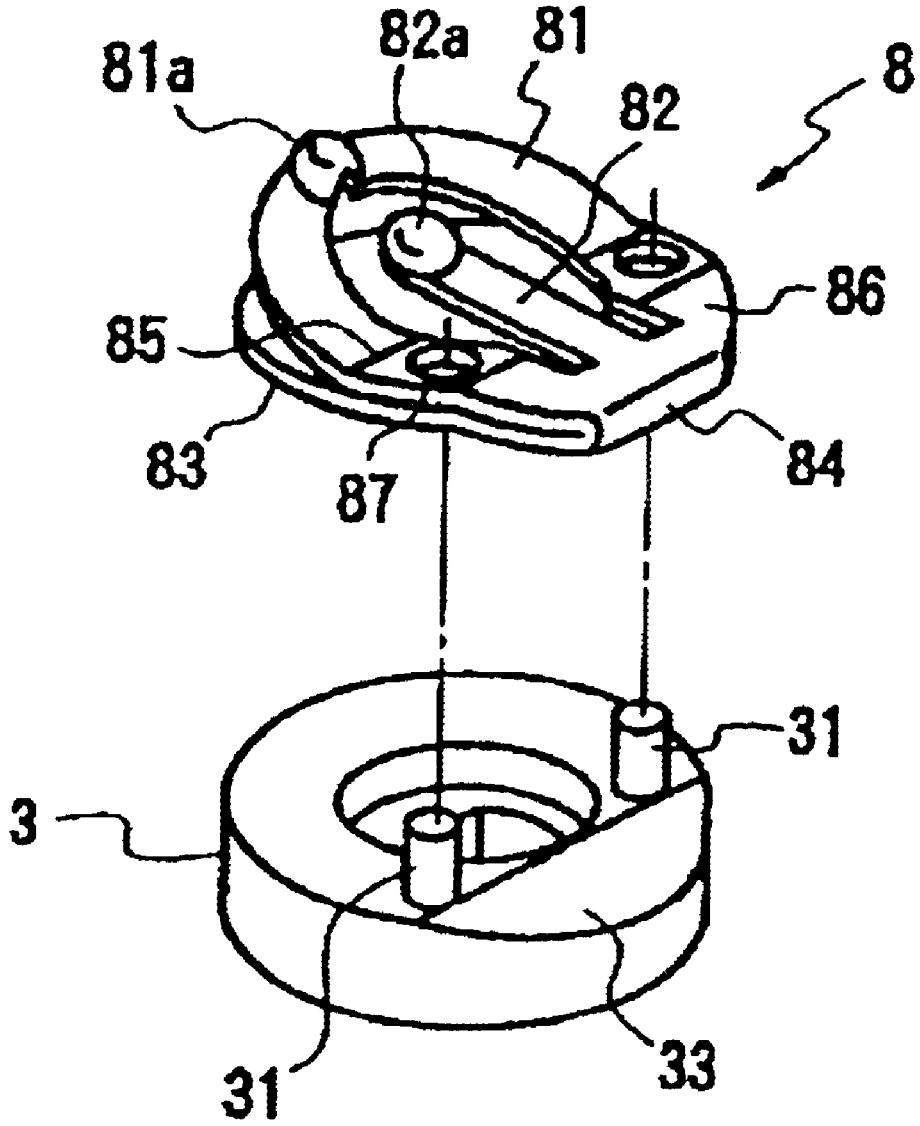
FIG. 10 is a perspective view illustrating the slider and rotor used in the variable resistor shown in FIG. 6, as viewed from the rear side.

The slider 8 is preferably made of a conductive thin metallic plate formed of a copper alloy, stainless steel, a precious metal based alloy, or other suitable material having good spring properties. The slider 8 is subjected to surface processing using a precious metal or other suitable material, as appropriate. As shown in FIG. 8, in the slider 8, an annular arm portion 81, a substantially I-shaped arm portion 82, and a base portion 83 are stamped out from one metallic plate. The annular arm portion 81, substantially I-shaped arm portion 82, and base portion 83 are folded back in a closely contacted state at the coupling portion 84. The annular arm portion 81 is bent up along the bending-up line 85 in a diametric direction, and a sliding contact 81*a*, for making sliding contact with the arcuate resistor 51 of the substrate 5, is arranged to protrude from the tip portion of the annular arm portion 81. The substantially I-shaped arm portion 82 extends in a direction that is substantially perpendicular to the bending-up line 85 of the annular arm portion 81. The substantially I-shaped arm portion 82 is a linear arm located inside the annular arm portion 81. A contact member 82*a* arranged to contact the collector electrode 52 is arranged to protrude from the tip of the substantially I-shaped arm portion 82.

The base portion 83 is constructed as a disk having substantially the same diameter as the annular arm portion 81. The base portion 83 extends up to the vicinity of the position corresponding to the tip portion of the annular arm portion 81 where the sliding contact member 81*a* is provided. The rear surface of the base portion 83 is supported by the surface of the rotor 3. A fold-back portion 86, near the coupling portion 84 where the base portion and the annular and I-shaped arm portions are folded and closely contacted, is folded in the direction opposite to the bending-up direction of the annular arm portion 81. The substantially I-shaped arm portion 82 is not folded, but is raised. That is, the substantially I-shaped arm portion 82 extends linearly from the folded-back point at the coupling portion 84. Corresponding to this fold back portion 86, an inclined surface 33 (see FIG. 10) is defined on the bottom surface of the rotor 3. A pair of through holes 87 and 88 for fitting the protrusions 31 of the rotor 3 are provided on the closely contacted surfaces of the annular arm portion 81 and the base portion 83. The through holes 87 and 88 are arranged substantially at bilaterally symmetrical positions around the substantially I-shaped arm portion 82. After the protrusions 31 have been inserted into the through holes 87 and 88, they are not required to be weld-caulked.

Figure 11A:
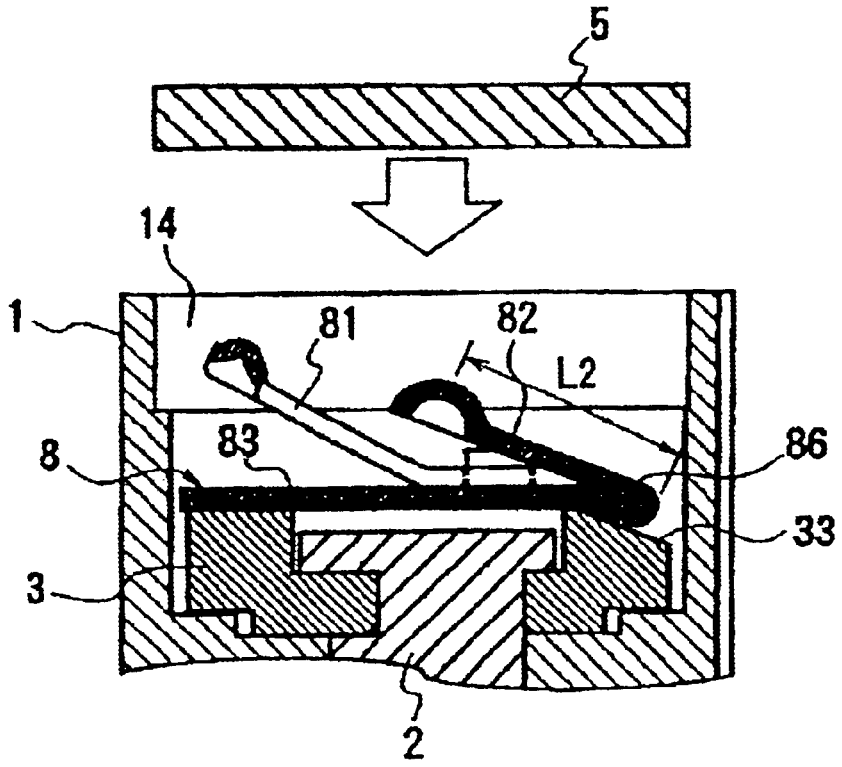
FIGS. 11A and 11B are partially sectional views illustrating the variable resistor before and after the substrate is built in the variable resistor shown in FIG. 6, respectively.
Figure 11B:
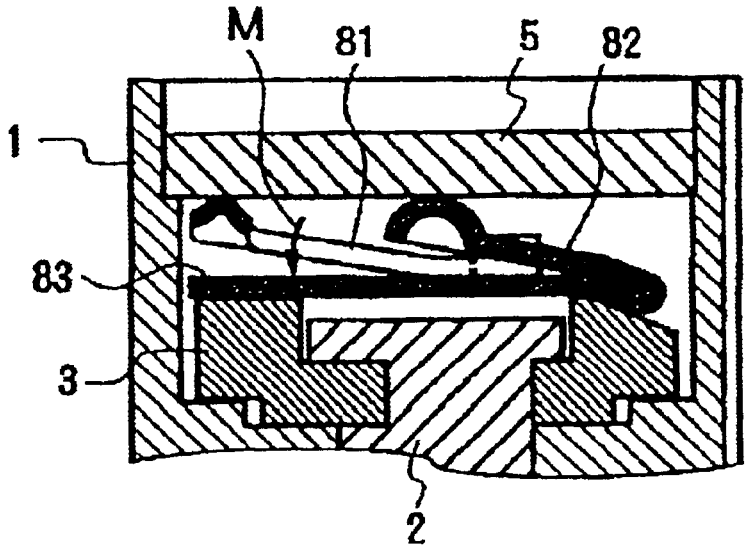

As described above, because the substantially I-shaped arm portion 82 extends linearly from the folded-back point at the coupling portion 84, the elastic region of the substantially I-shaped arm portion 82 becomes longer as shown in FIG. 11. That is, the effective spring length $L_2$ of the substantially I-shaped arm portion 82 becomes larger. This allows the contact pressure between the substantially I-shaped arm portion 82 and the collector electrode 52 to be set to an appropriate value.

Here, the effective spring length of the annular arm portion 81 is the distance from the bending-up line 85 to the sliding contact 81*a*.

In this preferred embodiment of the present invention, because the effective spring length of the annular arm portion 81 and that of the substantially I-shaped arm portion 82 of the slider 8 are substantially the same, the spring elasticity of the two arm portions 81 and 82 are also substantially the same.

As shown in FIG. 11, when the substrate 5 is assembled into the case 1, because both of the annular arm portion 81 and the substantially I-shaped arm portion 82 are subjected to a load, a moment in the backward-tilting direction occurs with respect to the slider 8 about the bending-up line 85 of the annular arm portion 81 (see FIG. 8B). However, because the slider 8 is integral with the base portion 83 and the rear surface of the base portion 83 is supported by the rotor 3, it is possible to stably support the slider 8 with respect to the moment M and to reliably prevent the slider 8 from backwardly tilting. This arrangement stabilizes the contact between the resistor 51 and the annular arm portion 81 and the contact between the collector electrode 52 and the substantially T-shaped arm portion 82, which greatly improves reliability.

The protrusions 31, which are fitted in the through holes 87 and 88, have no need to prevent the slider 8 from backwardly tilting, but have only to prevent the slipping rotation of the slider 8 with respect to the rotor 3. The protrusions 31, therefore, are not required to be weld-caulked. Also, because the protrusions 31 are subjected to only a small load, they can prevent a damage of the slider even if the protrusions 31 are small.

The present invention is not limited to the above-described preferred embodiments. The shape of the base portion 83 is not limited to a disk shape. Alternatively, any shape, such as an annular shape, a cross shape, or other shapes may be used. Corresponding to this, an engaging portion for stopping the rotation of the base portion 83 may also be provided on the bottom surface of the rotor 3. Any shape may be used which meets the conditions that the base portion 83 is supported by the rotor 3 over a wide region in the longitudinal direction of the annular arm portion 81 and that can support a moment M in the backward-tilting direction applied to the slider 8.

Also, although the annular arm portion 81, the substantially I-shaped arm portion 82, and the base portion 83 are folded back in a closely contacted state, they may be folded back without being closely contacted.

Furthermore, the outer shape of the case 1 is not limited to a substantially cylindrical shape, but it may be a square cylindrical shape or other shape. In this case, it is preferable that the outer shape of the substrate 5 be not a disk-like shape, but have a square-plate shape.

In the present invention, the shape of the annular arm portion of the slider is not limited to an annular shape in the strict sense. The term "annular shape" used herein is a concept including similar shapes. It is possible that the shape of the annular arm portion of the slider constitutes a closed loop. Also, the shape of the substantially I-shaped arm portion is not limited to an I-shaped configuration in the strict sense, but has only to be substantially linear.

When the annular arm portion and the substantially I-shaped arm portion are in pressure contact with the substrate, a moment in the backward-tilting direction acts on the slider around the bent up portion of the annular arm portion. Because the base portion is coupled with the annular arm portion and the substantially I-shaped arm portion by a folded-back structure, because the base portion extends up to the vicinity of the position corresponding to the tip portion of the annular arm portion, and because the rear surface of the base portion is supported by the rotor, the base portion supports the moment in the backward-tilting direction and prevents the slider from backwardly tilting. This arrangement stabilizes the contact between the resistor and the annular arm portion and the contact between the collector electrode and the substantially I-shaped arm portion, which leads to greatly improved reliability.

Moreover, in accordance with various preferred embodiments of the present invention, because the slider does not necessarily need to be fixed with respect to the rotor by weld-caulking, unlike the conventional art, and only the rotation of the slider with respect to the rotor needs to be stopped by any engaging structure, it is possible to simplify the assembling work.

While the present invention has been described with reference to the preferred embodiments thereof, many modifications may be applied in the light of the above teachings. It is therefore to be understood that within the scope of the appended claims, the invention may be practiced other than as specifically described.

What is claimed is:

1. A variable resistor comprising:

a case;

a rotor rotatably mounted in said case, said rotor being arranged to be rotationally operated from outside of the case;

a substrate provided in said case, said substrate having a collector electrode disposed at an approximately central portion of the surface of the substrate and having an arcuate resistor disposed on the surface of the substrate around said collector electrode so as to be substantially concentric therewith;

a slider mounted on said rotor so as to be rotatable together with said rotor;

said slider inducing:

a base portion with a rear surface being supported by said rotor;

an annular arm portion having a bent up portion bent along a bending line corresponding to a diameter of the annular arm portion and arranged to make sliding contact with said arcuate resistor of said substrate;

a substantially I-shaped arm portion located inside of the annular arm portion, extending in a direction that is substantially perpendicular to the bending line, and arranged to make contact with said collector electrode; and a folded back portion provided on one end of the base portion which directly connects the annular aim portion and the substantially I-shaped arm portion to the base portion.

2. A variable resistor according to claim 1, wherein said annular arm portion, said substantially I-shaped arm portion, and said base portion are disposed in close contact with each other.

3. A variable resistor according to claim 1, wherein said substantially I-shaped arm portion is raised without folding said substantially I-shaped arm portion and is raised by a portion of the folded back portion which is bent in a direction opposite to the direction of the bent up portion of said annular arm portion.

4. A variable resistor according to claim 3, wherein an inclined surface is provided on a bottom surface of the rotor corresponding to the folded back portion of the slider in the direction opposite to the bending-up direction of the annular arm portion.

5. A variable resistor according to claim 1, wherein the case has a lower-end opening portion and the substrate is fixed to the lower-end opening portion of the case.

6. A variable resistor according to claim 1, further comprising protrusions provided on the bottom surface of the rotor and arranged to prevent slipping rotation of the slider with respect to the rotor.

7. A variable resistor according to claim 1, wherein the substrate includes through holes and lead terminals extend through the through holes in the substrate.

8. A variable resistor according to claim 1, wherein a sliding contact member for making sliding contact with the arcuate resistor of the substrate is arranged to protrude from a tip portion of the annular arm portion.

9. A variable resistor according to claim 1, wherein a contact member arranged to contact the collector electrode is arranged to protrude from a tip portion of the substantially I-shaped arm portion.

10. A variable resistor according to claim 1, wherein the base portion has a disk configuration having substantially the same diameter as the annular arm portion.

11. A variable resistor according to claim 1, wherein the rotor includes protrusions and a pair of through holes for fitting the protrusions of the rotor are provided in the annular arm portion and the base portion.

12. A variable resistor according to claim 1, wherein an effective spring length of the annular arm portion and an effective spring length of the substantially I-shaped arm portion of the slider are substantially the same.

13. A variable resistor according to claim 1, wherein a spring elasticity of the annular arm portion and the substantially I-shaped arm portion are substantially equal.

14. A hearing aid comprising:

a variable resistor including:

a case;

a rotor rotatably mounted in said case, said rotor being arranged to be rotationally operated from outside of the case;

a substrate provided in said case, said substrate having a collector electrode disposed at an approximately central portion of the surface of the substrate and having an arcuate resistor disposed on the surface of the substrate around said collector electrode so as to be substantially concentric therewith;

a slider mounted on said rotor so as to be rotatable together with said rotor;

said slider including:

a base portion with a rear surface being supported by said rotor;

an annular arm portion having a bent up portion bent along a bending line and arranged to make sliding contact with said arcuate resistor of said substrate;

a substantially I-shaped arm portion located inside of the annular arm portion, extending in a direction that is substantially perpendicular to the bending line, and arranged to make contact with said collector electrode; and a folded back portion provided on one end of the base portion which directly connects the annular arm portion and the substantially I-shaped arm portion to the base portion.

15. A hearing aid according to claim 14, wherein said annular arm portion, said substantially I-shaped arm portion, and said base portion are disposed in close contact with each other.

16. A hearing aid according to claim 14, wherein said substantially I-shaped arm portion is raised without folding said substantially I-shaped arm portion and is raised by a portion of the folded back portion which is bent in a direction opposite to the direction of the bent up portion of said annular arm portion.

17. A hearing aid according to claim 16, wherein an inclined surface is provided on a bottom surface of the rotor corresponding to the folded back portion of the slider in the direction opposite to the bending-up direction of the annular arm portion.

18. A hearing aid according to claim 14, wherein the case has a lower-end opening portion and the substrate is fixed to the lower-end opening portion of the case.

19. A hearing aid according to claim 14, further comprising protrusions provided on the bottom surface of the rotor and arranged to prevent slipping rotation of the slider with respect to the rotor.

20. A hearing aid according to claim 14, wherein the substrate includes through holes and lead terminals extend through the through holes in the substrate.

21. A hearing aid according to claim 14, wherein a sliding contact member for making sliding contact with the arcuate resistor of the substrate is arranged to protrude from a tip portion of the annular arm portion.

22. A hearing aid according to claim 14, wherein a contact member arranged to contact the collector electrode is arranged to protrude from a tip portion of the substantially I-shaped arm portion.

23. A hearing aid according to claim 14, wherein the base portion has a disk configuration having substantially the same diameter as the annular arm portion.

24. A hearing aid according to claim 14, wherein the rotor includes protrusions and a pair of through holes for fitting the protrusions of the rotor are provided in the annular arm portion and the base portion.

25. A hearing aid according to claim 14, wherein an effective spring length of the annular arm portion and an effective spring length of the substantially I-shaped arm portion of the slider are substantially the same.

26. A hearing aid according to claim 14, wherein a spring elasticity of the annular arm portion and the substantially I-shaped arm portion are substantially equal.

* * * * *